US006496163B1

(12) United States Patent
Iseki

(10) Patent No.: US 6,496,163 B1
(45) Date of Patent: Dec. 17, 2002

(54) PLASMA DISPLAY PANEL HAVING LARGE OFFSET MARGIN FOR ASSEMBLAGE AND CONTROLLING METHOD USED THEREIN

(75) Inventor: Koki Iseki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/135,563

(22) Filed: Aug. 18, 1998

(30) Foreign Application Priority Data

Aug. 18, 1997 (JP) ..... 9-221297

(51) Int. Cl.[7] ..... G09G 3/28

(52) U.S. Cl. ..... 345/60; 345/61; 345/62; 345/65; 345/66; 345/67; 345/78; 345/88; 345/59; 345/55; 313/581; 315/168; 315/169.1

(58) Field of Search ..... 345/60, 61, 64, 345/67, 54, 63, 87, 62, 65, 66, 78, 88; 313/581; 315/169.1, 168

(56) References Cited

U.S. PATENT DOCUMENTS 5,903,245 A * 5/1999 Shimizu et al. ..... 345/60
6,097,357 A * 8/2000 Shinoda et al. ..... 345/63
6,118,220 A * 8/2000 Shino et al. ..... 345/60
6,144,348 A * 11/2000 Kanazawa et al. ..... 345/60
6,208,082 B1 * 3/2001 Kim et al. ..... 345/69.1
6,271,811 B1 * 8/2001 Shimizu et al. ..... 345/68

FOREIGN PATENT DOCUMENTS

| | | |
|---|---|---|
| JP | 55-29852 | 3/1980 |
| JP | 03-125187 | 5/1991 |
| JP | 09-274859 | 10/1997 |

OTHER PUBLICATIONS

M. Uchidoi et al., "Panel Design and Driving Method of 40–in. Diagonal AC Plasma Displays", *IDW '96*, 1996, pp. 291–294.

M. Uchidoi et al., "Panel Design and Driving Method of 40–in. Diagonal AC Plasma Display", 40–inch Diagonal AC Plasma Display Panel Design and Drive Method, pp. 291–297 with Abstract.

* cited by examiner

*Primary Examiner*—Richard Hjerpe
*Assistant Examiner*—Ali Zamani
(74) *Attorney, Agent, or Firm*—Sughrue Mion, PLLC

(57) ABSTRACT

A memory type alternating current plasma display panel has two pixel blocks on both sides of a spacer wall, and scanning/sustain electrode pairs for the two pixel blocks respectively have the innermost sustain electrodes closer to the spacer wall than the associated scanning electrodes so as to increase an offset margin during assemblage of panel structures.

12 Claims, 16 Drawing Sheets

PLASMA DISPLAY PANEL HAVING LARGE OFFSET MARGIN FOR ASSEMBLAGE AND CONTROLLING METHOD USED THEREIN

FIELD OF THE INVENTION

This invention relates to plasma display panel and, more particularly, to a structure of a plasma display panel for increasing an offset margin for assemblage and a controlling method used therein.

DESCRIPTION OF THE RELATED ART

The plasma display panel has various attractive features. The plasma display panel is thin, free from flicker and large in contrast. It is easy to provide a wide display area, and the viewing angle is large. The plasma display panel is promptly responsive to an image signal, and a vivid full color image is produced in the wide display area. The plasma display panel is, by way of example, used as an image display unit of a computer system.

The plasma display panel is broken down into two categories. One of the categories is called as "alternating current plasma display panel". The alternating current plasma display panel has electrodes covered with a dielectric layer, and alternating current is applied between the electrodes so as to generate discharge in the discharge gas. The other category is called as "direct current plasma display panel", and the electrodes are directly exposed to discharge gas. Direct current is applied to the electrodes, and the electrode generates discharge. The dielectric layer protects the electrodes of the alternating current plasma display panel from the ion bombardment, and is durable rather than the electrodes of the direct current plasma display panel.

The alternating current plasma display panel is further broken down into two sub-categories, i.e., refresh type and memory type. The alternating current plasma display panel varies the illuminance together with the repetition of discharge during a frame. The discharge takes place at each pulse, and the repetition of discharge is proportional to the number of pulses applied to the electrode during the frame. The memory type alternating current plasma display panel can adjust the number of pulses applied to each of the electrodes to an arbitrary value. On the other hand, the refresh type alternating current plasma display panel decreases the displaying time and, accordingly, the repetition of discharge on each scanning line inversely to the displaying capacity. For this reason, the memory type alternating current plasma display panel widely varies the illuminance of an image rather than the refresh type alternating current plasma display panel, and is appropriate to a wide display area. On the other hand, the refresh type alternating current plasma display panel is appropriate to a narrow display area.

A typical example of the memory type alternating current plasma display panel has discharging space between two substrate structures, and three kinds of electrodes are formed on the inner surfaces of the two substrate structures. Two kinds of electrodes are arranged on one of the substrate structures, and are used for sustain discharge. The remaining electrodes are patterned on the other substrate structure, and are used for write-in discharge together with one of the two kinds of electrodes.

FIG. 1 illustrates a pixel of the prior art memory type alternating current plasma display panel. The prior art memory type alternating current plasma display panel largely comprises two substrate structures 1/2 and spacers 3 for creating discharging space 4 between the substrate structures 1 and 2. The substrate structure 1 provides a display area, and an image is produced therein.

The substrate structure 1 includes a front transparent panel 1*a,* a scanning electrode 1*b* formed on the inner surface of the front transparent panel 1*a,* a sustain electrode 1*c* formed on the inner surface in parallel to the scanning electrode 1*b,* a dielectric layer 1*d* covering the scanning/sustain electrodes 1*b*/1*c* and a protective layer 1*e* laminated on the dielectric layer 1*d.* On the other hand, the other substrate structure 2 includes a back panel 2*a,* a data electrode 2*b* extending on the inner surface of the back panel 2*a* in perpendicular to the scanning/sustain electrodes 1*b*/1*c,* a dielectric layer 2*c* covering the data electrode 2*b* and a phosphor layer 2*d* laminated on the dielectric layer 2*c.* The discharging space 4 is filled with discharge gas such as helium, neon, xenon or gaseous mixture thereof, and the spacer 3 defines the pixel. The discharge gas radiates ultra-violet light, and the phosphor layer 2*d* converts the ultra-violet light to visible light 5. The visible light 5 passes through the front panel 1*a,* and forms a part of an image produced in the display area. The protective layer 1*e* is formed of magnesium oxide, and prevents the dielectric layer 1*d* from bombardment during the discharge.

The prior art memory type alternating current plasma display panel produces an image as follows. The pixel shown in FIG. 1 is required to emit the visible light 5. Firstly, a scanning pulse signal is applied between the scanning electrode 1*b* and the data electrode 2*b,* and the pulse height is larger than the threshold of discharge. The scanning pulse signal causes the discharge gas to initiates the discharge, and positive/negative charges takes place. The phosphor layer 2*d* converts the ultra-violet light to the visible light 5, and the visible light 5 forms a part of the image. The positive charge and the negative charge are attracted to the scanning electrode 1*b* and the data electrode 2*b,* and are accumulated on the inner surfaces of the substrate structures 1/2, respectively. The accumulated wall charges are inverse in polarity to the potential levels on the scanning/data electrodes 1*b*/2*b,* and reduce the effective potential difference between the scanning electrode 1*b* and the data electrode 2*b.* As a result, even though the scanning pulse signal is still applied between the scanning electrode 1*b* and the data electrode 2*b,* the pixel can not continue the discharge.

The wall charges are obstacle to continuation of the discharge. In order to eliminate or neutralize the wall charge, sustain pulse signal is alternately applied between the scanning electrode 1*b* and the sustain electrode 1*c.* Although the sustain pulse signal is lower than the threshold of discharge, the sustain pulse signal is identical in polarity with the wall charge on the substrate structure 1, and the wall charge causes the effective potential difference to exceed over the threshold of discharge. For this reason, the discharge is continued during the alternation of the sustain pulse signal between the scanning electrode 1*b* and the sustain electrode 1*c.* This is the memory function.

In this situation when the wall charge is eliminated or neutralized, the pixel stops the discharge. An erase pulse signal is applied to either scanning or sustain electrode 1*b*/1*c.* Then, the pixel can not continue the discharge, and the visible light is extinguished.

The pixels are arranged in rows and columns as shown in FIG. 2, and forms a display area 6. Circles represent the pixels, respectively. The scanning electrodes Sc1, Sc2, . . . and Scj are paired with the sustain electrodes Su1, Su2, . . . and Suj, respectively, and the scanning/sustain electrode pairs Sc1/Su1, Sc2/Su2, . . . and Scj/Suj are associated with the rows of pixels, respectively. On the other hand, data electrodes Da1, Da2, Da3, Da4, . . . , Dak-1 and Dak extend in perpendicular to the scanning/sustain electrode pairs Sc1/Su1 to Scj/Suj, and are respectively associated with the columns of pixels. The phosphor layers 2*d* are colored in the three primary colors, i.e., red, green and blue, and a color image is produced on the display area 6.

The pixels are controlled as shown in FIG. 3. Each frame is divided into plural sub-fields SF1 to SF6, and each sub-field SF1 to SF6 is further divided into a preliminary discharge period A, an erasing period B, a write-in discharge period C and a sustain discharge period D1/D2/D3/D4/D5/D6. The sustain discharge period D1 is continued for T, and the sustain discharge periods D2 to D6 are successively decreased to T/2, T/4, T/8/T/16 and T/32.

All the pixels are discharged in the preliminary discharge period A, and stop the preliminary discharge in the erasing period B. The scanning pulse signal is sequentially supplied to the scanning electrodes Sc1 to Scj in the write-in discharge period C, and line L1 represents the signal application timing in the write-in discharge period C. Certain pixels to be fired are selected from the pixel array during the write-in discharge period C. Upon completion of the application of the scanning signal, the sustain pulse signal is alternately applied to all the scanning/sustain electrode pairs so as to emit the visible light from the selected pixels. The sustain discharge period is reduced at $1/2^n$, and a combination of the sustain discharge periods D1 to D6 determines the illuminance of each pixel. Thus, the prior art control method shown in FIG. 3 achieves a gradation of $2^6$.

The potential levels on the sustain/scanning/data electrodes are varied as shown in FIG. 4. A preliminary discharge pulse signal PS1 is applied to all the sustain electrodes Su1 to Suj in the preliminary discharge period A, and all the pixels are fired. An erasing pulse signal PS2 is applied to the scanning electrodes S1 to Sj in the erasing period B. As a result, active particles are produced, and the wall charges are accumulated. This results in that the pixels become promptly responsive to a scanning pulse signal PS3.

The scanning pulse signal PS3 is sequentially applied to the scanning electrodes S1 to Sj, and a data pulse signal PS4 are selectively applied to the data electrodes Da1 to Dak. When the scanning pulse signal PS3 and the data pulse signal PS4 are concurrently applied to a scanning electrode and a data electrode, a pixel defined by the scanning electrode and the data electrode is fired, and enters into the write-in state. This means that the wall charges take place in the fired pixel.

A sustain pulse signal PS5 is alternately applied to the sustain electrodes Su1 to Suj and the scanning electrodes Sc1 to Scj, and the pixels in the write-in state are continuously fired.

The pixels have been miniaturized, and, accordingly, the manufacturer has increased the scanning/sustain electrode pairs and the data electrodes of the prior art memory type alternating current plasma display panel. The prior art memory type alternating current plasma display panel with increased scanning/sustain electrode pairs requires the write-in discharge period C longer than the write-in discharge period for the standard memory type alternating current plasma display panel, and each sub-field is prolonged. If the manufacturer keeps the time period for each sub-field constant, it is necessary to make the scanning pulse signal narrower, and the wall charge in a selected pixel is too little to sustain the firing in the sustain discharge period.

When the manufacturer is expected to increase the gradation, each frame requires—requires the sub-fields more than those of the standard memory type alternating current plasma display panel, and the time period for each sub-field is shrunk. As a result, the scanning pulse signal PS2 is narrowed, and certain selected pixels are misfired due to insufficient wall charge.

The total time TC for the write-in discharge periods C in each frame is expressed as $$TC=Tw\times Ln\times Sf \qquad \text{equation 1}$$

where Tw is the pulse width of the scanning pulse signal PS3, Ln is the number of the scanning electrodes and Sf is the number of the sub-fields. When the frame frequency is adjusted to f, the time for each frame is given by equation 2.

$$1/f=TC+T\alpha \qquad \text{equation 2}$$

where Tα is the total time period of the preliminary discharging period A, the erasing period B and the sustain discharge period D. When the number of scanning electrodes is increased or the number of sub-fields is increased, the total time period TC is prolonged. On the other hand, when the frame frequency is increased, the time period for each frame 1/f is shrunk, and the total time period Tα is forced to be shorter. If the manufacturer reduces the sustain discharge period D, the pixels can not achieve a target illuminance. For this reason, the manufacturer usually decreases the sub-fields, and, accordingly, reduces the gradation.

Thus, the prior art controlling method shown in FIG. 3 reaches a technical barrier. M. Uchidoi et al propose an improvement in "Panel Design and Driving Method of 40-in. Diagonal AC Plasma Displays", IDW'96, pages 291 to 294. Uchidoi et al divide the electrodes to be scanned into two groups, and the two groups are concurrently scanned for selectively changing the pixels to the write-in state. As a result, the total write-in discharge period is reduced to a half of the above described prior art memory type alternating current plasma display panel. The controlling sequence proposed by Uchidoi et al allows the manufacturer to increase the scanning electrodes, the sub-fields and/or the frame frequency without reduction of the gradation.

FIG. 5 illustrates the memory type alternating current plasma display panel proposed by Uchidoi et al. Small ellipses represent pixels, respectively, and are arranged in rows and columns. The rows of pixels are divided into two groups 11 and 12, which are hereinbelow referred to as "upper group 11" and "lower group 12". Scanning electrodes Sc1 to Scj are divided into two groups Sc1/Sc2/ . . . /Scj/2 and Scj/2+1/ . . . /Scj, and are respectively paired with sustain electrodes Su1/Su2/ . . . /Suj+2, Suj/2+1/ . . . /Suj. The scanning/sustain electrode pairs Sc1/Su1 to Scj/Suj are also divided into two groups Sc1/Su1 . . . Scj/2/Suj/2 and Scj/2+1/Suj/2+1 . . . Scj/Suj, and are respectively associated with the rows of pixels in the upper group 11 and the rows of pixels in the lower group 12. Two groups of data electrodes Du1 to Duk and Dd1 to Ddk are prepared for the upper group 11 and the lower group 12, and are respectively associated with the columns of pixels in the upper group 11 and the columns of pixels in the lower group 12.

The prior art memory type alternating current plasma display panel shown in FIG. 5 produces an image through the following control sequence. FIG. 6 illustrates the control sequence. Each sub-field is divided into the preliminary discharge period A, the erasing period B, the write-in discharge period C and the sustain discharge period D.

A preliminary discharge pulse signal PS11 is applied to all the sustain electrodes Su1 to Suj in the preliminary discharge period A, and an erasing pulse signal PS12 is applied to all the scanning electrodes Sc1–Scj in the erasing period B. The upper group 11 and the lower group 12 are concurrently scanned with a scanning pulse signal PS13 in the write-in discharge period C, and a data pulse signal PS14 is selectively applied to the data electrodes Du1 to Duk and the data electrodes Dd1 to Ddk.

In detail, the scanning pulse signal PS13 is concurrently applied to the first scanning electrode Sc1 of the upper group 11 and the first scanning electrode Scj/2+1 of the lower group 12, and the other scanning electrodes of the upper group 11 and the other scanning electrodes of the lower group 12 are sequentially scanned with the scanning pulse signal PS13. Finally, the scanning electrode Scj/2 of the upper group 11 and the scanning electrode Scj of the lower group 12 are concurrently scanned with the scanning pulse signal PS13. Pixels concurrently applied with the scanning pulse signal PS13 and the data pulse signal PS14 enter into the write-in state. Thus, the selective write-in is concurrently carried out for the upper group 11 and the lower group 12.

A sustain pulse signal PS15 are alternately applied to the sustain electrodes Su1 to Suj and the scanning electrodes Sc1 to Scj in the sustain discharge period.

When each frame consists of six sub-fields SF1 to SF6, the scanning pulse signal PS13 is sequentially applied to the scanning electrodes Sc1 to Scj/2 and Scj/2+1 to Scj as shown in FIG. 7. The scanning pulse signal PS13 is applied to the scanning electrodes Sc1 to Scj/2 as indicated by arrow L2 and to the scanning electrodes Scj/2+1 to Scj as indicated by arrow L3. The arrow L2 is moved in parallel to the arrow L3, and the write-in discharge is completed within a half of the time period consumed by the prior art standard memory type alternating current plasma display panel. Thus, the manufacturer can increase the scanning electrodes of the prior art memory type alternating current plasma display panel and the sub-fields in each frame without sacrifice of the gradation and the quality of image to be produced. However, the manufacturer encounters a problem in the prior art memory type alternating current plasma display panel proposed by Uchidoi in the assemblage between the two-substrate structures.

In detail, the substrate structures 1 and 2 are separately manufactured, and are assembled with one another. In the prior art standard memory type alternating current plasma display panel, the data electrodes Da1 to Dak are shared between all the scanning electrodes Sc1 to Scj. Even if the substrate structures 1/2 are offset from each other, the offset equally affects all the pixels, and the write-in discharging characteristics are not changed among the pixels. However, the prior art memory type alternating current plasma display panel proposed by Uchidoi et al has two groups of data electrodes Du1–Duk and Dd1–Ddk, and the group Du1–Duk is spaced from the other group Dd1–Ddk. If the substrate structure is offset from the other substrate structure, the overlapping area between the scanning electrodes Scj/2 and Scj/2+1 and the data electrodes Du1–Duk/Dd1–Ddk are unevenly varied, and the pixels on both sides of the boundary between the pixel groups 11 and 12 differently vary the write-in discharging characteristics as described hereinbelow in detail.

FIG. 8 shows one of the pixels incorporated in the prior art memory type alternating current plasma display panel proposed by Uchidoi et al. A spacer 20 is patterned into a lattice configuration, and defines a rectangular parallelopiped space 21 assigned to the pixel. A scanning electrode 22 and a sustain electrode 23 extend across the pixel in parallel to each other, and a gap 24 takes place between the scanning electrode 22 and the sustain electrode 23. A data electrode 25 projects into the pixel, and the leading end of the data electrode 25 is designated by reference 25*a* . If the offset varies the leading end 25*a* from Y0 through Y1, Y2 to Y3, the overlapping area between the scanning electrode 22 and the data electrode 25 is increased, and the scanning electrode 22 and the data electrode 25 start the write-in discharge at lower potential as shown in FIG. 9.

Even if the leading end 25*a* exceeds over Y3, the minimum potential is not lowered. Therefore, the difference between Y2 and Y3 is the target range for the data electrode 25. FIGS. 10A to 10D illustrate two pixels 21A/21B opposed to each other across the boundary between the two groups 11 and 12. Alphabetic letters "A" and "B" are added to the references designating the electrodes of the pixel 21A and the references designating the electrodes of the pixel 21B. The scanning electrodes 22A and 22B are corresponding to the scanning electrodes Scj/2 and Scj/2+1.

L1, L2 and W' are representative of the projection of the data electrode 25A from the associated scanning electrode 22A, the projection of the data electrode 25B from the associated scanning electrode 22B and the distance between the scanning electrodes 22A and 22B. When the two substrate structures are assembled without any offset margin, the leading ends 25A*a* and 25B*a* are positioned at Y3, and the projections L1 and L2 are adjusted to L0 as shown in FIG. 10A. The minimum potential is stable at L0.

In order to offer an offset margin X' for the assemblage, the data electrode 25A is maintained at L1=L0, and the data electrode 25B is allowed to have the leading end 25B*a* at the limit where the data electrode 25B and the scanning electrode 22A are barely prevented from misfiring. The leading end 25B*a* is positioned at L2=X'+L0, and the distance between the leading end 25B*a* and the scanning electrode 22A is represented by G min as shown in FIG. 10B.

If the substrate structures are offset from the target position shown in FIG. 10B in the direction of arrow AR21, the data electrode 25A projects from the associated pixel, and the data electrode 25B is retracted into the associated pixel as shown in FIG. 10C. If the substrate structures are widely offset from the target position, the leading end 25B*a* projects from the scanning electrode 22B by L0, and the data electrode 25A further penetrates under the sustain electrode 23A so as to have the leading end 25A*a* at L1=X'+L0.

If the distance between the leading end 25A*a*/25B*a* and the scanning electrode 22B/22A is less than G min, the non-selected pixel is fired. Therefore, the offset margin X' for the assemblage is given by equation 3.

$$X' = \{W' - (L0 + G\ \min)\} \qquad \text{equation 3}$$

Thus, the manufacturer encounters the problem in the prior art memory type alternating current plasma display panel proposed by Uchidoi in that the offset margin is extremely small.

SUMMARY OF THE INVENTION

It is therefore an important object of the present invention to provide a plasma display panel, which has a large offset margin.

It is also an important object of the present invention to provide a method for controlling the plasma display panel.

To accomplish the object, the present invention proposes to arrange two groups of scanning/sustain electrodes in symmetry with respect to a boundary between the two groups.

In accordance with one aspect of the present invention, there is provided a plasma display panel comprising a plurality of pixel blocks having at least first pixel block and a second pixel block provided on one side of a boundary and the other side of the boundary, a plurality of first scanning electrodes extending in a first direction, a plurality of first sustain electrodes extending in the first direction, respectively paired with the plurality of first scanning electrodes so as to form a plurality of first electrode pairs selectively associated with pixels of the first pixel block and having the inner most first sustain electrode closer to the boundary than the associated innermost first scanning electrode, a plurality of first data electrodes opposed to the plurality of first electrode pairs through a first discharging space, extending in a second direction perpendicular to the first direction and selectively associated with the pixels of the first pixel block, a plurality of second scanning electrodes extending in the first direction, a plurality of second sustain electrodes extending in the first direction, respectively paired with the plurality of second scanning electrodes so as to form a plurality of second electrode pairs selectively associated with pixels of the second pixel block and having the inner most second sustain electrode closer to the boundary than the associated innermost second scanning electrode and a plurality of second data electrodes opposed to the plurality of second electrode pairs through a second discharging space, extending in the second direction and selectively associated with the pixels of the second pixel block.

In accordance with another aspect of the present invention, there is provided a method for controlling a plasma display panel including first sustain electrodes respectively paired with first scanning electrodes so as to form first electrode pairs, second sustain electrodes respectively paired with second scanning electrodes so as to form second electrode pairs, data electrodes opposed to the first electrode pairs and the second electrode pairs for defining a first pixel block and a second pixel block and a boundary opposed to an innermost first sustain electrode and an innermost second sustain electrode closest thereto, and the step comprises the steps of generating a write-in discharge between the data electrodes and the first and second scanning electrodes in such a manner that the write-in discharge sequentially takes place in the first pixel block in a first direction and in the second pixel block in a second direction opposite to the first direction with respect to the boundary and generating a sustain discharge in pixels entered in a write-in state in the previous step.

BRIEF DESCRIPTION OF THE DRAWINGS

The features and advantages of the memory type alternating current plasma display panel and the controlling method will be more clearly understood from the following description taken in conjunction with the accompanying drawings in which.

DESCRIPTION OF THE PREFERRED EMBODIMENTS

First Embodiment

Figure 11:
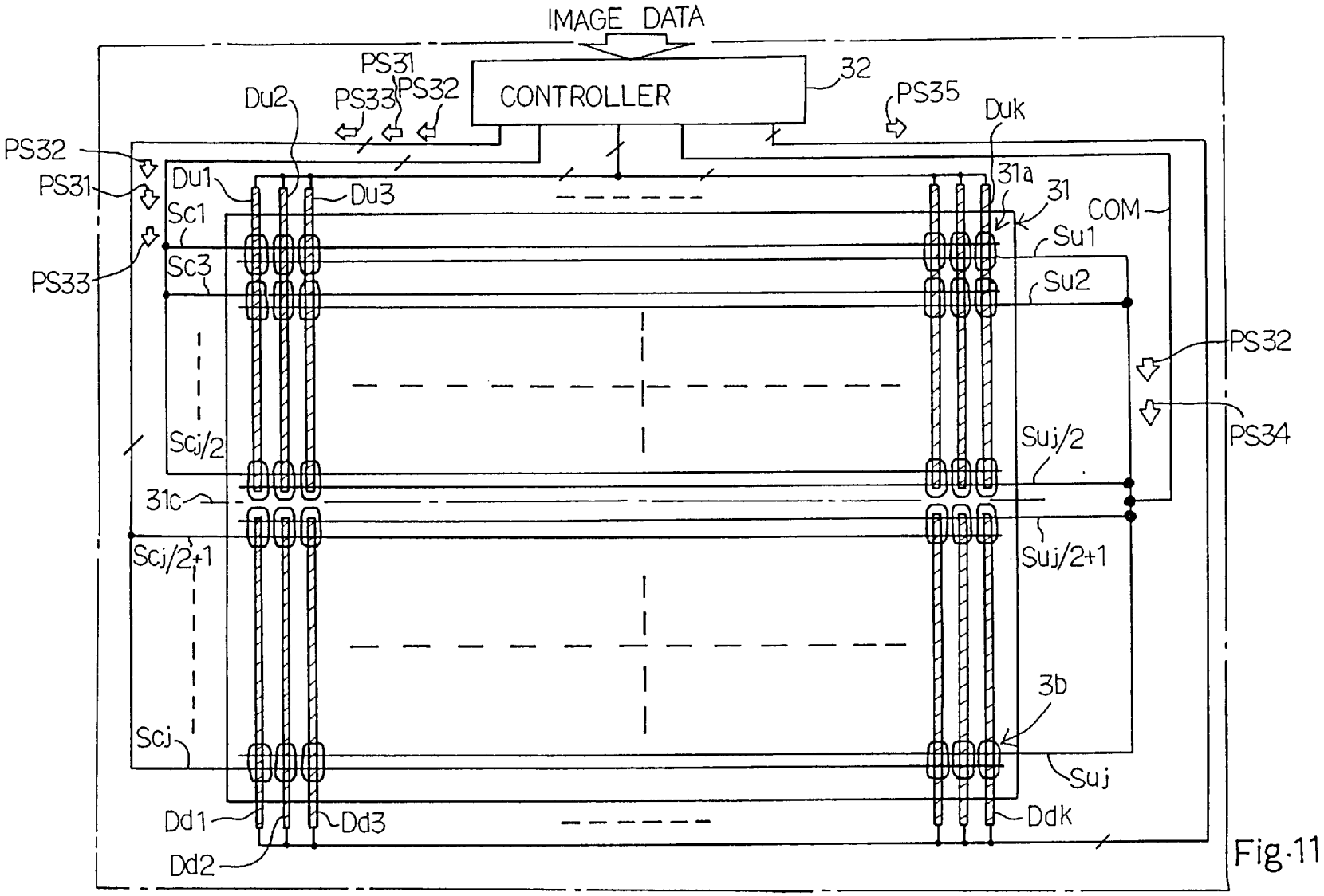
FIG. 11 is a plane view showing the arrangement of a memory type alternating current plasma display panel according to the present invention.
Figure 12:
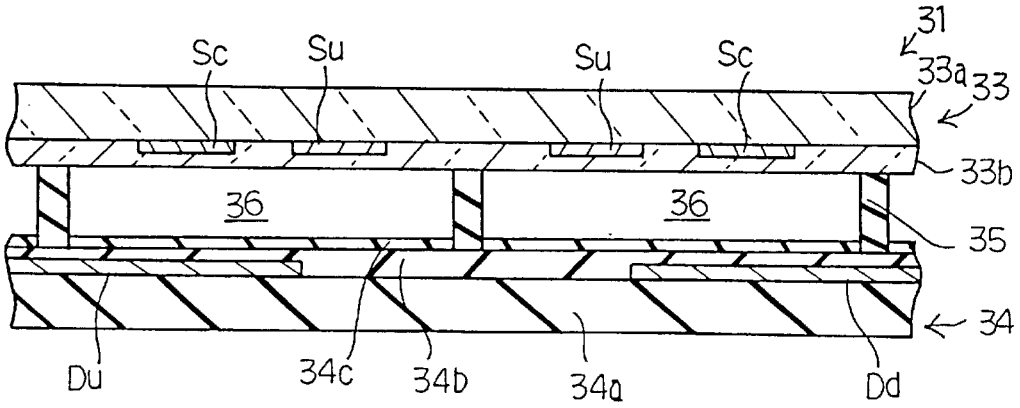
FIG. 12 is a cross sectional view showing the structure of a pixel array incorporated in the memory type alternating current plasma display panel.

Referring to FIG. 11 of the drawings, a memory type alternating current plasma display panel embodying the present invention largely comprises a pixel array 31 and a controller 32. The pixel array 31 forms a display area, and produces a visual image on the display area. As shown in FIG. 12, a front substrate structure 33, a back substrate structure 34 and a lattice shaped spacer 35 form in combination the pixel array 31.

The front substrate structure 33 includes a front transparent panel 33*a*, scanning electrodes Sc formed on the inner surface of the front transparent panel 33*a*, sustain electrodes Su formed on the inner surface in parallel to the scanning electrodes Sc, and a dielectric structure 33*b* covering the scanning/sustain electrodes Sc/Su, and the dielectric structure 33*b* may be implemented by a lamination of a dielectric layer and a protective layer as similar to the prior art structure. The scanning electrodes Sc are respectively paired with the sustain electrodes Su, and plural scanning/sustain electrode pairs Sc/Su are arranged on the inner surface of the front transparent panel 33*a*.

The back substrate structure 34 includes a back panel 34*a*, data electrodes Du/Dd extending on the inner surface of the back panel 34*a* in perpendicular to the scanning/sustain electrodes Sc/Su, a dielectric layer 34*bc* covering the data electrodes Du/Dd and a phosphor layer 34*cd* laminated on the dielectric layer 34*b*. The lattice-shaped spacer 35 creates discharging spaces 36, and the discharging spaces 36 are filled with the discharge gas. The data electrode Du1/Dd, the scanning/sustain electrode pair Sc/Su are associated with each discharging space 36, and define each pixel.

Turning back to FIG. 11 of the drawings, small ellipses are representative of the pixels, and the pixels form two pixel blocks 31*a*/31*b*. The pixels of each pixel block 31*a*/31*b* are arranged in rows and columns, and the pixel block 31*a* is opposed to the other pixel block 31*b* across a boundary 31*c*.

The scanning electrodes Sc are respectively associated with the rows of pixels in the pixel blocks 31*a*/31*b*, and are labeled with Sc1, Sc2, Scj/2, Scj/2+1, . . . and Scj, respectively. The scanning electrodes Sc1 to Scj are connected to the controller 32 in parallel, and the controller 32 selectively supplies a scanning pulse signal PS31 to the scanning electrodes Sc1 to Scj/2 and Scj/2+1 to Scj. The controller 32 further supplies a sustain pulse signal PS32 to all the scanning electrodes Sc1–Scj/2 and Scj/2+1–Scj. In this instance, the scanning electrodes Sc1 to Scj/2 are associated with the pixel block 31*a*, and the remaining scanning electrodes Scj/2+1 to Scj are associated with the other pixel block 31*b*. An erasing pulse signal PS33 is further supplied from the controller 32 to the scanning electrodes Sc1 to Scj.

The sustain electrodes Su are respectively associated with the rows of pixels, and are labeled with Su1, Su2, . . . , Suj/2, Suj+1, . . . and Suj. The sustain electrodes Su1 to Suj are connected to a common signal line COM, and the common signal line COM is connected to the controller 32. For this reason, the controller supplies the sustain pulse signal PS32 and a preliminary discharge pulse signal PS34 to all the sustain electrodes Su1–Suj/2 and Suj/2+1–Suj.

In this instance, each of the scanning/sustain electrode pairs Sc1/Su1 to Scj/2/Suj/2 has the sustain electrode Su1–Suj/2 closer to the boundary 31*c* than the associated scanning electrode Sc1–Scj/2, and each of the scanning/sustain electrode pairs Scj/2+1/Suj/2+1 to Scj/Suj also has the sustain electrode Suj/2+1–Suj closer to the boundary 31*c* than the associated scanning electrode Scj/2+1–Scj. Thus, the boundary 31*c* is an axis of symmetry between the scanning/sustain electrode pairs Sc1/Su1 to Scj/2/Suj/2 and the scanning/sustain electrode pairs Scj/2+1/Suj/2+1 to Scj/Suj.

The data electrodes Du and Dd are respectively associated with the columns of pixels in the pixel block 31*a* and the columns of pixels in the other pixel block 31*b*. The data electrodes Du for the pixel block 31*a* are labeled with Du1, Du2, Du3, . . . and Duk, respectively, and the data electrode Dd for the other pixel electrode 31*b* are labeled with Dd1, Dd2, Dd3, . . . and Ddk, respectively. The data electrodes Du1–Duk and Dd1–Ddk are connected in parallel to the controller 32, and the controller 32 selectively supplies a data pulse signal PS35 to the data electrodes Du1–Duk and Dd1–Ddk.

Figure 13:
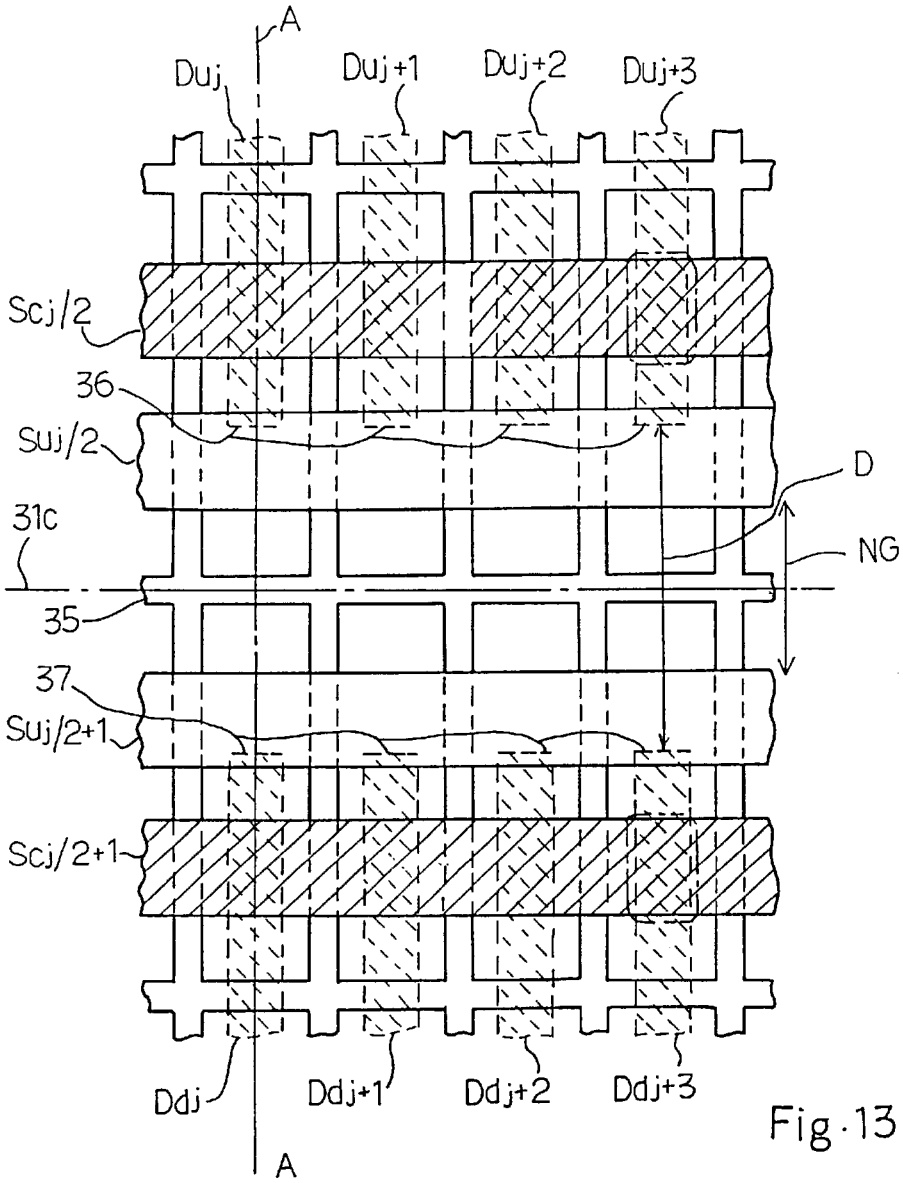
FIG. 13 is a plane view showing the arrangement of electrodes around the boundary of two pixel blocks.

The symmetrical arrangement is clear on both sides of the boundary 31*c* as shown in FIG. 13. In order to easily discriminate the scanning electrodes Scj/2 and Scj/2+1, the sustain electrode Suj/2 and Suj/2+1 and the data electrodes Duj to Duj+3 and Ddj to Ddj+3 from one another, the scanning electrodes Scj/2 and Scj/2+1 and the data electrodes Duj to Duj+3 and Ddj to Ddj+3 are differently hatched in FIG. 13. The structure shown in FIG. 12 is taken along line A—A of FIG. 13. The data electrodes Duj to Duj+3 are overlapped with the scanning electrode Scj/2, and the leading ends 36 of the data electrodes Duj to Duj+3 reach positions under the sustain electrode Suj/2. Similarly, the data electrodes Ddj to Ddj+3 are overlapped with the scanning electrode Scj/2+1, and the leading ends 37 of the data electrodes Ddj to Ddj+3 reach positions under the sustain electrode Suj/2+1. In FIG. 13, "NG" and "D" represent non-discharge gap and the distance between the data electrodes Duj to Duj+3 and the data electrodes Ddj to Ddj+3.

The positions of the leading ends 36/37 are determined in such a manner that the scanning electrodes Scj/2/Scj/2+1 and the data electrodes Duj–Duj+3/Ddj–Ddj+3 start the write-in discharge at the minimum potential difference and that the write-in discharge is never generated between the data electrodes Duj–Duj+3/Ddj–Ddj+3 and the non-associated scanning electrodes Scj/2+1 and Scj/2.

In detail, FIGS. 14A to 14D illustrate relative position between the data electrodes Du/Dd and the scanning electrodes Scj/2/Scj/2+1 under different offset. L1 and L2 represent the projection of the leading end 36 from the associated scanning electrode Scj/2 and the projection of the leading end 37 from the associated scanning electrode Scj/2+1. "W" is indicative of the distance between the scanning electrodes Scj/2 and Scj/2+1. In the following description, reference "G min" represents a limit where the data electrode Dd or Du and the non-associated scanning electrode Scj/2 or Scj/2+1 are barely prevented from unintentional write-in discharge.

Figures 14A, 14B, 14C, 14D:
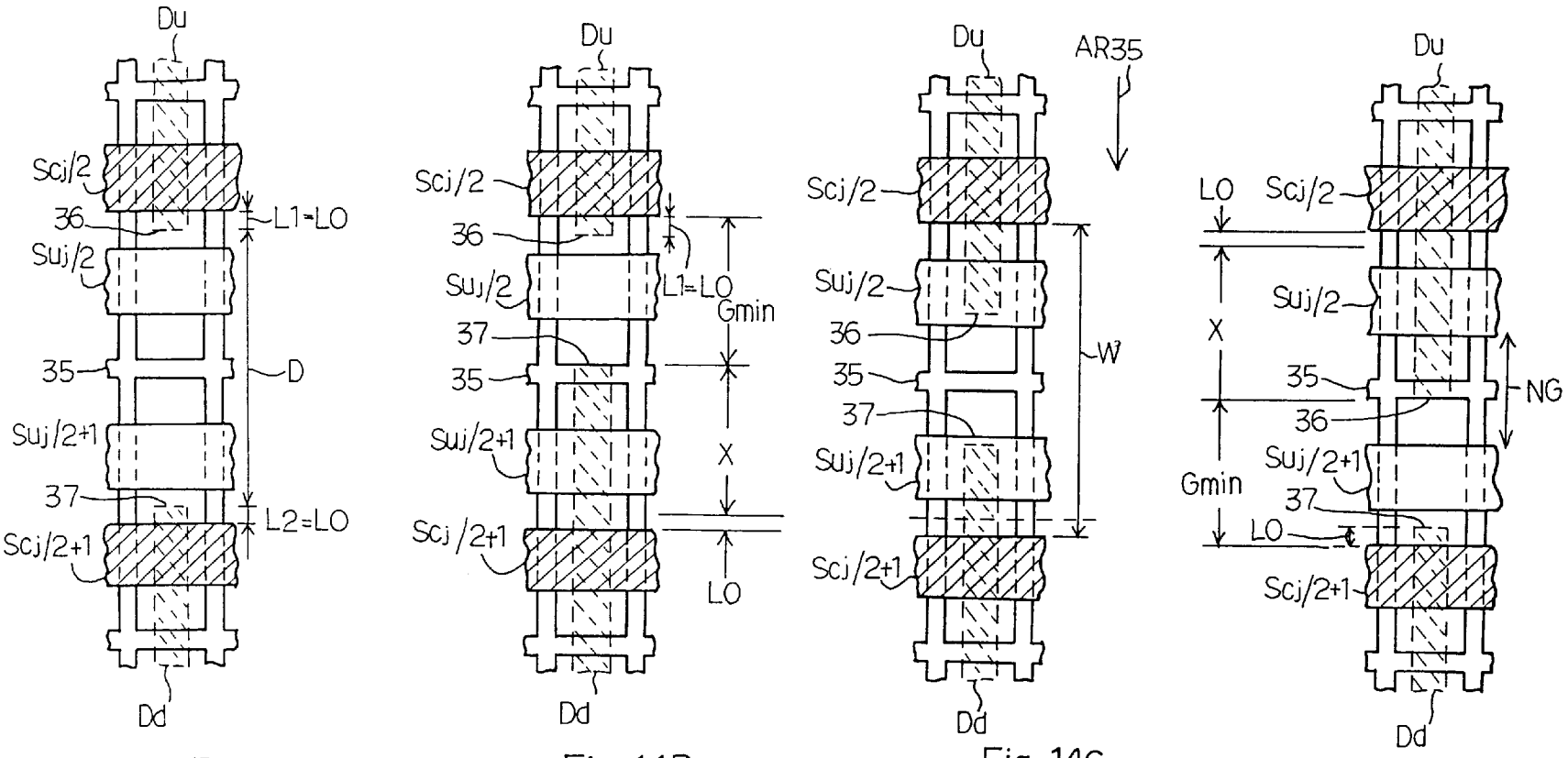
FIGS. 14A to 14D are plane views showing the relative position between the scanning electrodes and the data electrodes under the different offset.

If L1 and L2 are designed to be equal to L0 as shown in FIG. 14A, the margin for assemblage is zero. Although the data electrode Du maintains the leading end 36 at L0, the other data electrode Dd projects to the limit G min. Then, the leading end 37 is equal to the total of L0 and X as shown in FIG. 14B.

If the back substrate structure 34 is undesirably offset from the front substrate structure 31 with respect to the assembled state shown in FIG. 14B as indicated by arrow AR35 during the assemblage, the data electrode Du projects into the space under the sustain electrode Suj/2, and the other data electrode Dd is retracted into the space under the sustain electrode Suj/2+1 as shown in FIG. 14C. The limit G min is maintained between the data electrodes Du/Dd and the non-associated scanning electrodes Scj/2+1 and Scj/2.

When the offset is increased so that the leading end 36 reaches the limit LM, the leading end 36 is located at L1=X+L0, and the other data electrode Dd decreases the projection to L0 as shown in FIG. 14D. For this reason, the offset margin X is given by the following equation.

$$X=W-(L0+G\ \text{min}) \qquad \text{equation 4}$$

Comparing equation 4 with equation 3, constant (L0+G min) is subtracted from the distance between the scanning electrodes W'/W. Only one sustain electrode 23A is provided between the scanning electrodes 22A and 22B in the prior art memory type alternating current plasma display panel (see FIGS. 10A to 10D). On the other hand, two sustain electrodes Suj/2 and Suj/2+1 are provided between the scanning electrodes Scj/2 and Scj/2+1 in the memory type alternating current plasma display panel according to the present invention. For this reason, the distance W is wider than the distance W', and, accordingly, the offset margin X is larger than the offset margin X'.

The memory type alternating current plasma display panel produces an image on the display area in each frame, and the frame is divided into plural sub-fields SF1 to SF6. Each sub-field SF1 to SF6 is further divided into a preliminary discharging period A, an erasing period B, a write-in discharge period C and a sustain discharge period D1 to D6 (see FIG. 16), and the sustain discharge period is decreased from T through T/2, T/4, T/8, T/16 to T/32 so as to offer the gradation of $2^6$.

The controller 32 supplies the preliminary discharge pulse signal PS34 to all the sustain electrodes Su1 to Suj in the preliminary discharge period A, and the erasing pulse signal PS33 to all the scanning electrodes Sc1 to Scj in the erasing period B.

The controller sequentially supplies the scanning pulse signal PS31 to both of the scanning electrode groups Sc1–Scj/2 and Scj/2+1–Scj in the write-in discharge period C, and selectively supplies the data pulse signals PS35 to the associated data electrodes Du1–Duk and Dd1–Ddk. Firstly, the scanning pulse signal PS31 is concurrently supplied to the scanning electrodes Sc1/Scj, and the scanning electrodes are sequentially changed from Sc1/Scj to Scj/2/Scj/2+1. The scanning is indicated by arrows AR36/AR37 in FIG. 15, and the scanning sequence makes the write-in discharge characteristics uniform.

The data pulse signal PS35 is selectively supplied to the data electrodes Du1–Duk and Dd1–Ddk concurrently with the scanning pulse signal PS31. For this reason, pixels concurrently supplied with the data pulse signal PS35 and the scanning pulse signal PS31 are fired, and enter into the write-in state.

As will be understood from the foregoing description, the symmetrical arrangement of the scanning/sustain electrodes makes the offset margin large, and the manufacturer easily improves the production yield.

Figure 15:
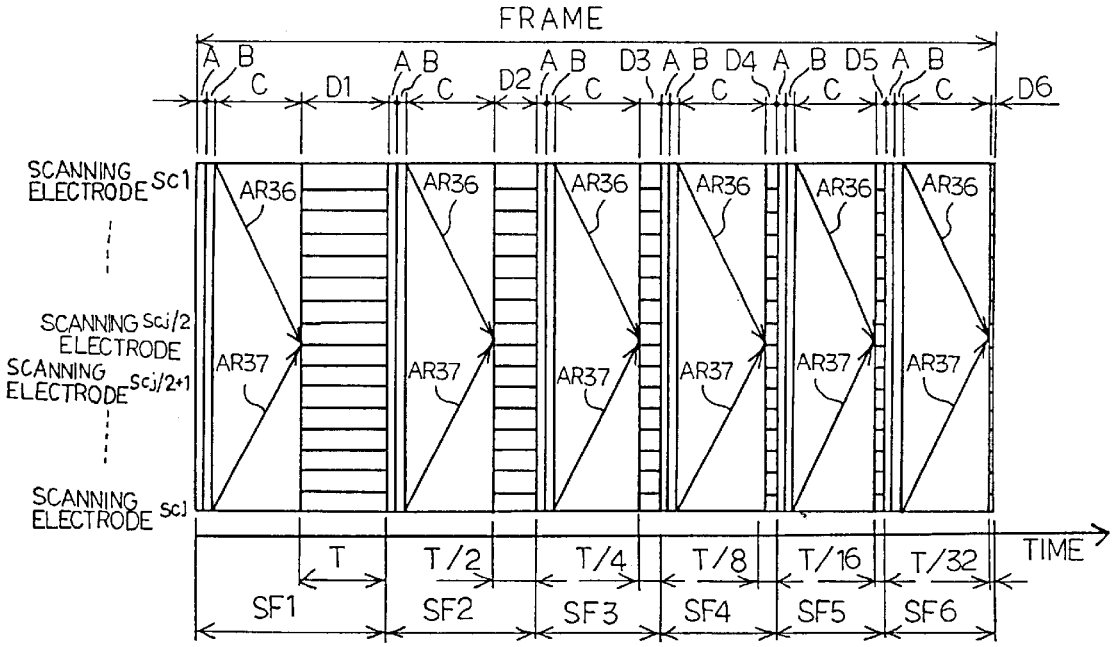
FIG. 15 is a timing chart showing a control sequence for the memory type alternating current plasma display panel.
Figure 16:
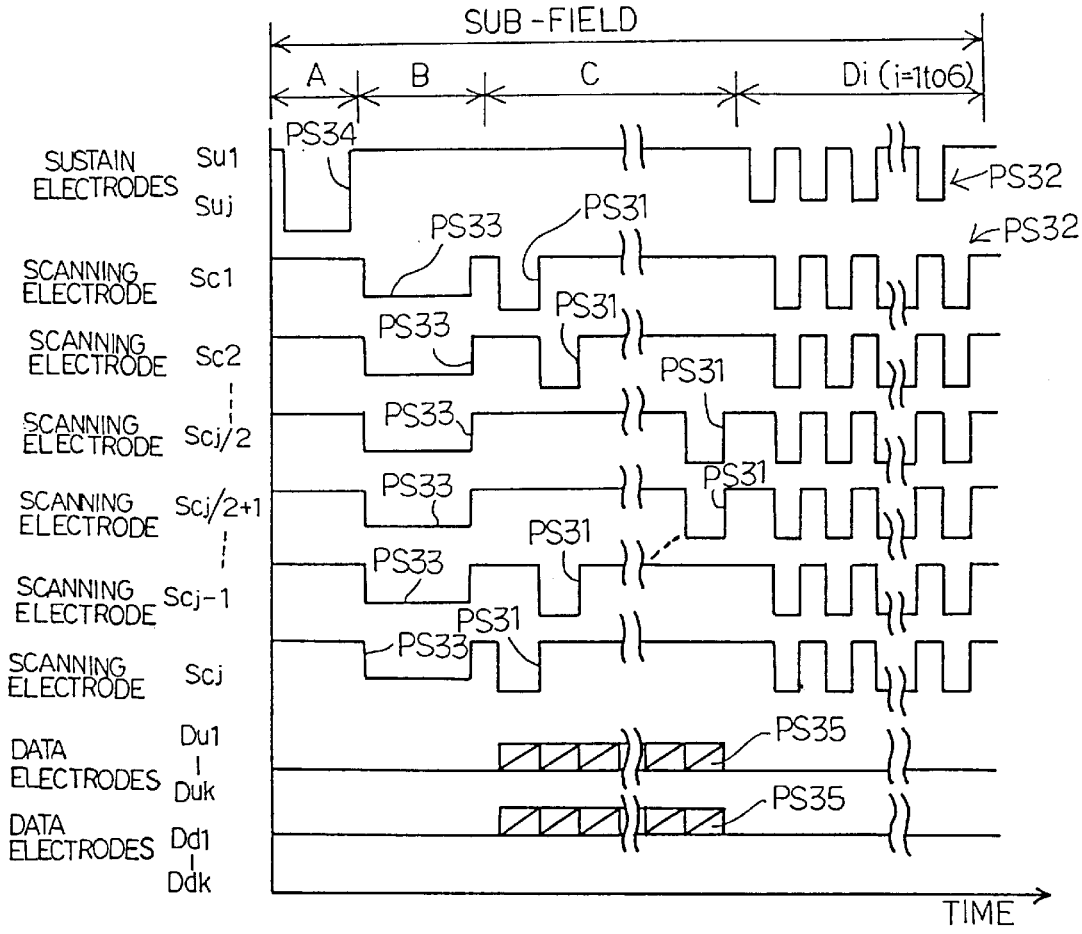
FIG. 16 is a diagram showing the waveforms of pulse signals in each sub-field.

The controlling method shown in FIGS. 15 and 16 appropriately drives the memory type alternating current plasma display panel according to the present invention for producing an image on the display area.

Second Embodiment

Figure 17:
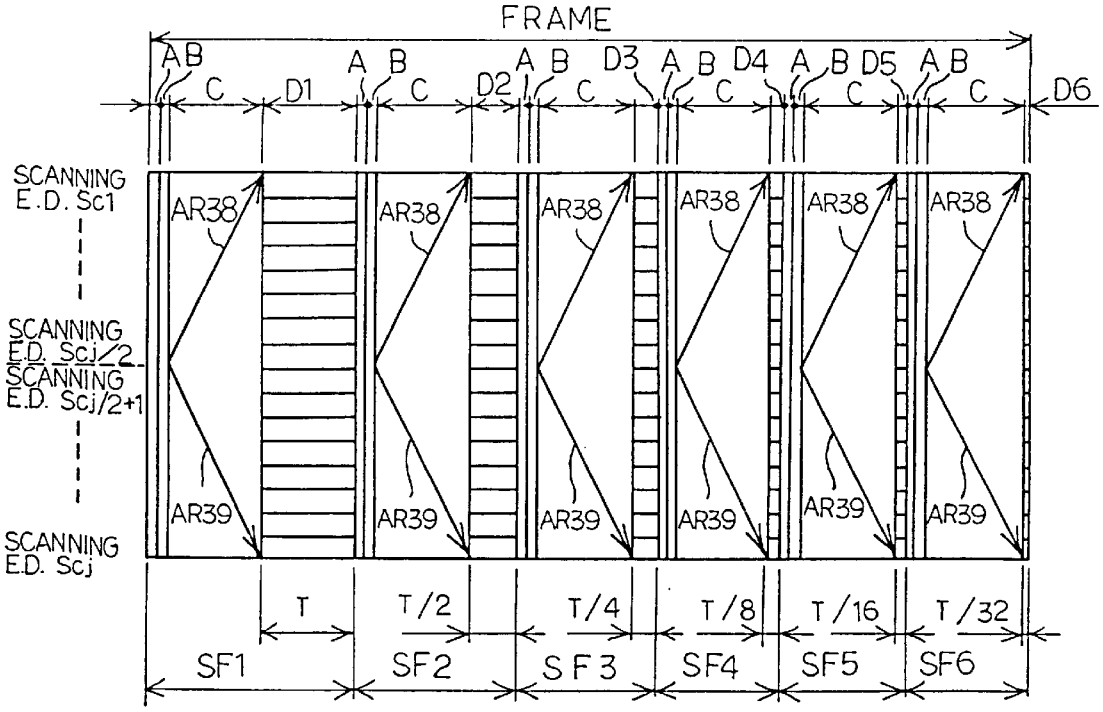
FIG. 17 is a timing chart showing another control sequence for the memory type alternating current plasma display panel according to the present invention.

FIG. 17 illustrates another control sequence for a memory type alternating current plasma display panel embodying the present invention. The memory type alternating current plasma display panel implementing the second embodiment is similar to the first embodiment, and no further description is incorporated hereinbelow for the sake of simplicity.

The control sequence shown in FIG. 17 is only different from the control sequence shown in FIG. 15 in the scanning direction. Although the controller 32 of the first embodiment changes the scanning electrodes from Sc1/Scj toward Scj/2/Scj/2+1, the controller 32 of the second embodiment changes the scanning electrodes from Scj/2/Scj/2+1 toward Sc1/Scj as indicted by arrows AR38/AR39. The second embodiment achieves all the advantages of the first embodiment.

Third Embodiment

Figure 18:
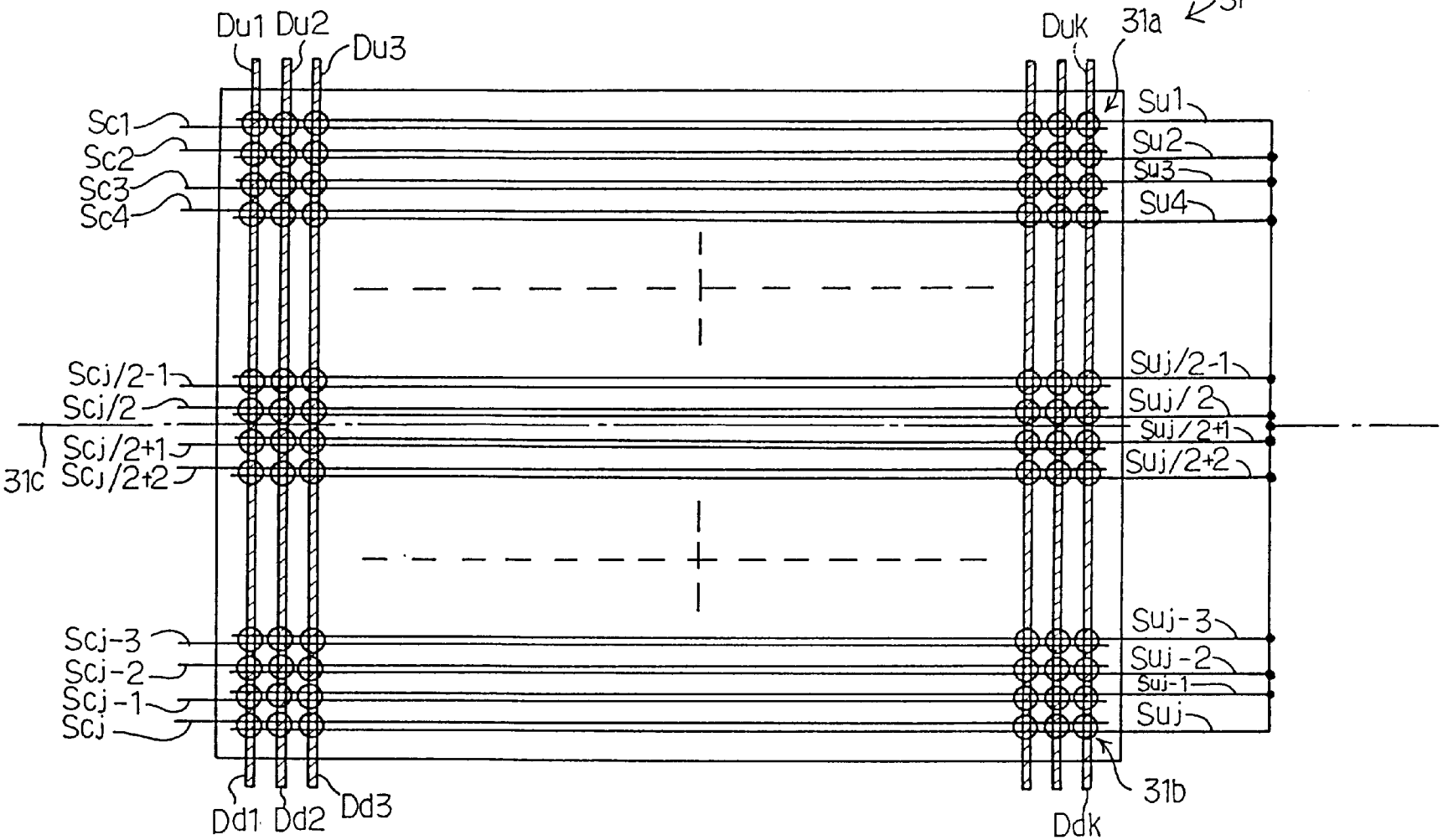
FIG. 18 is plane view showing the arrangement of yet another memory type alternating current plasma display panel according to the present invention.

FIG. 18 illustrates yet another memory type alternating current plasma display panel embodying the present invention. The memory type alternating current plasma display panel implementing the third embodiment is similar to the first embodiment except for the arrangement of scanning/sustain electrodes. For this reason, pixel blocks and electrodes are labeled with the same references designating corresponding pixel blocks and electrodes of the first embodiment, and description is focused on the arrangement of scanning/sustain electrodes hereinbelow.

The outermost scanning/sustain electrode pairs Sc1/Su1 and Scj/Suj have the scanning electrodes Sc1/Scj closer to the boundary 31*c* than the associated sustain electrodes Su1/Suj. The next scanning/sustain electrode pairs Sc2/Su2 and Scj−1/Suj−1 have the sustain electrodes Su2/Suj−1 closer to the boundary 31*c* than the associated scanning electrodes Sc2/Scj−1. Thus, the scanning electrode and the associated sustain electrode alternately change the positions. However, the sustain electrodes Suj/2/Suj/2+1 are closer to the boundary 31*c* than the associated scanning electrodes Scj/2/Scj/2+1 in the innermost scanning/sustain electrode pairs as similar to the first embodiment. Thus, there are two sustain electrodes Suj/2/Suj/2+1 between the innermost scanning electrodes Scj/2 and Scj/2+1, and the arrangement of the scanning/sustain electrodes offers large offset margin to the manufacturer.

The control sequence shown in FIG. 15 or 17 is available for the memory type alternating current plasma display panel implementing the third embodiment.

As will be appreciated from the foregoing description, plural sustain electrodes are provided between the innermost scanning electrodes, and the arrangement of scanning/sustain electrodes increases the offset margin. Moreover, when the scanning/sustain electrodes are arranged in symmetry with respect to the boundary, the controller sequentially supplies the scanning pulse signal to the scanning electrodes in such a manner that the scanning direction for one pixel block is opposite to the scanning direction for the other pixel block, and the write-in characteristics are made uniform through the control sequence according to the present invention.

Although particular embodiments of the present invention have been shown and described, it will be obvious to those skilled in the art that various changes and modifications may be made without departing from the spirit and scope of the present invention.

Figure 1:
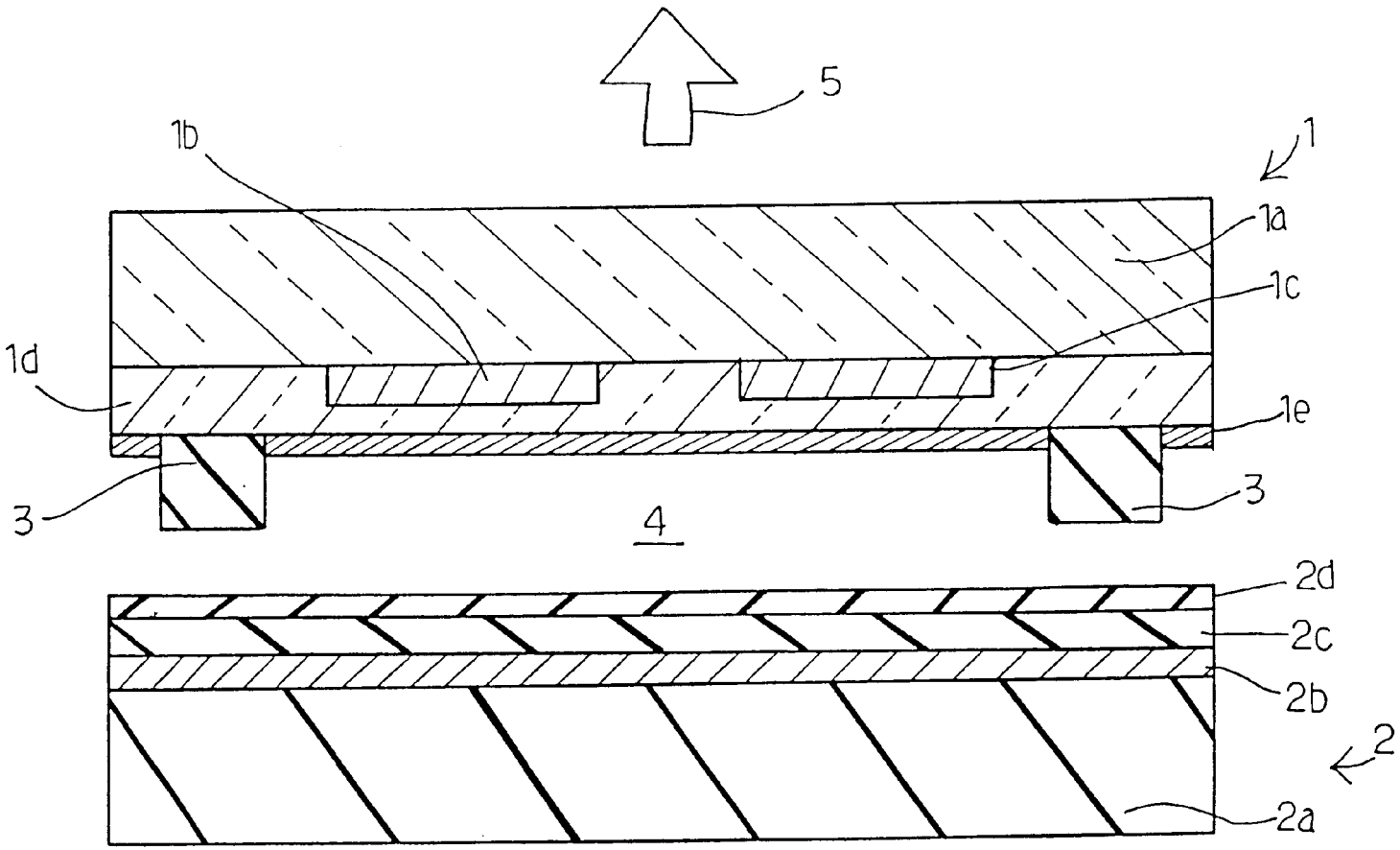
Fig. 1 PRIOR ART
FIG. 1 is a cross sectional view showing the structure of the pixel incorporated in the prior art memory type alternating current plasma display panel.
Figure 2:
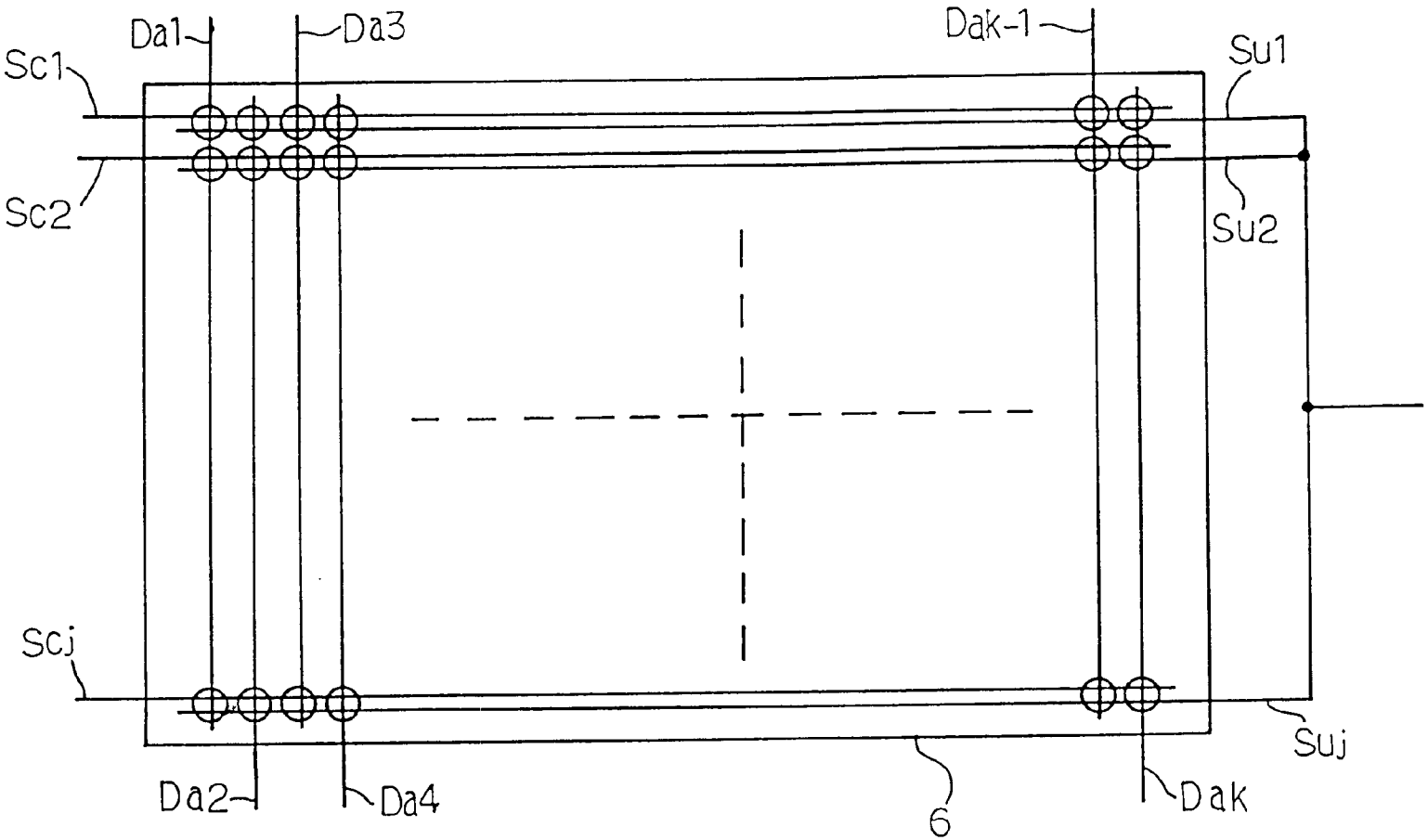
Fig. 2 PRIOR ART
FIG. 2 is a plane view showing the arrangement of the pixels and the electrodes in the prior art memory type alternating current plasma display panel.
Figure 3:
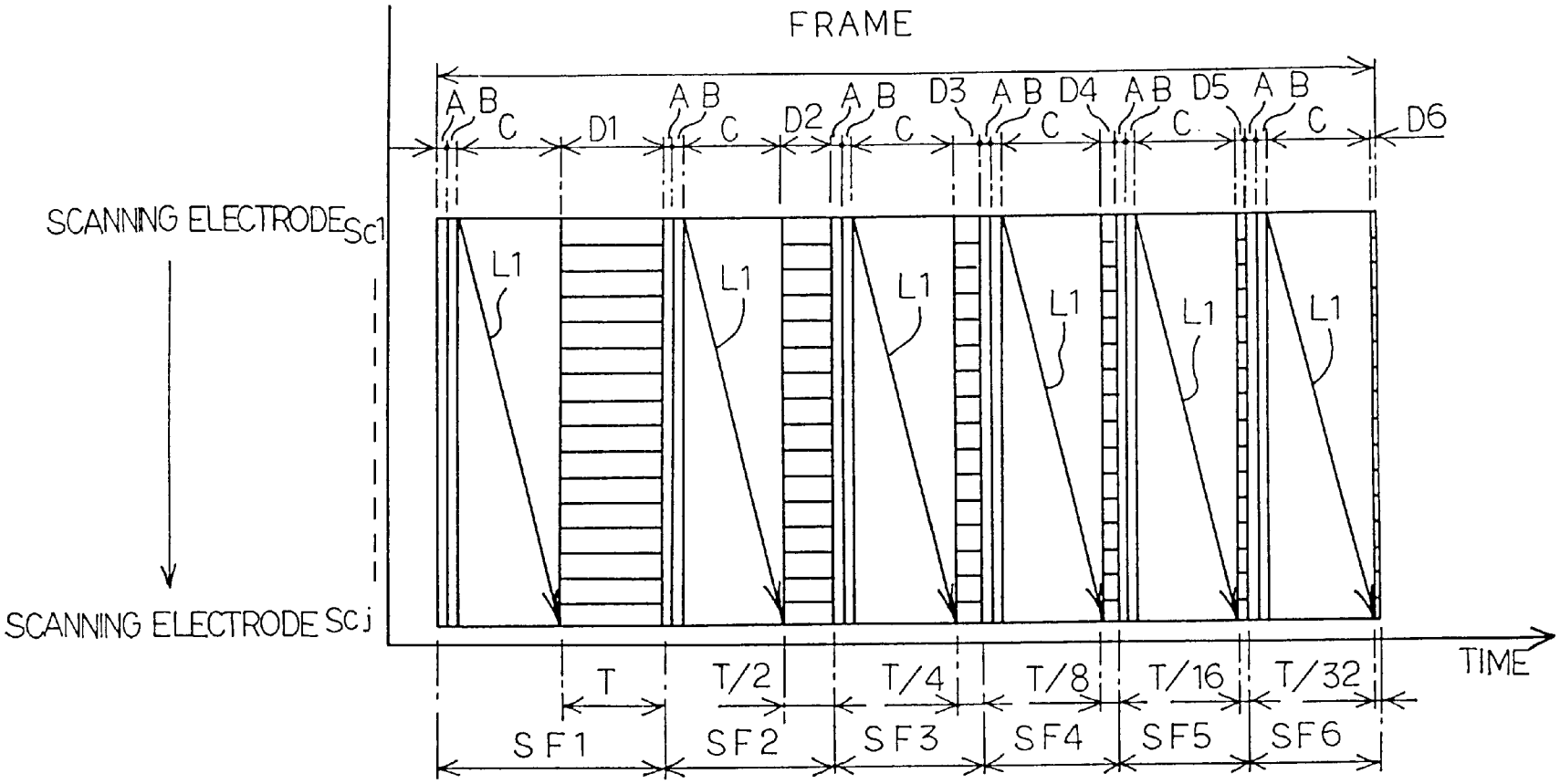
Fig. 3 PRIOR ART
FIG. 3 is a timing chart showing the standard control sequence applied to the prior art memory type alternating current plasma display panel.
Figure 4:
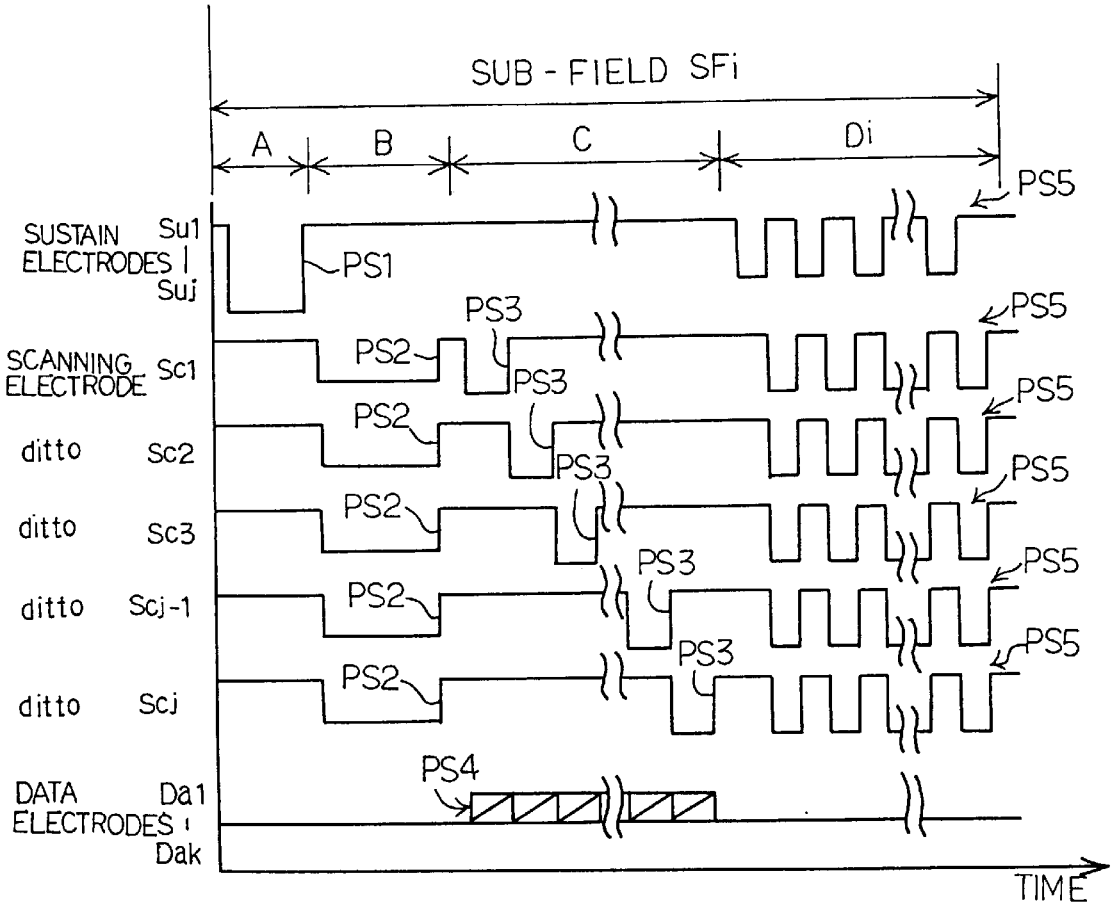
Fig. 4 PRIOR ART
FIG. 4 is a diagram showing the variation of potential levels on the electrodes during the sub-field.
Figure 5:
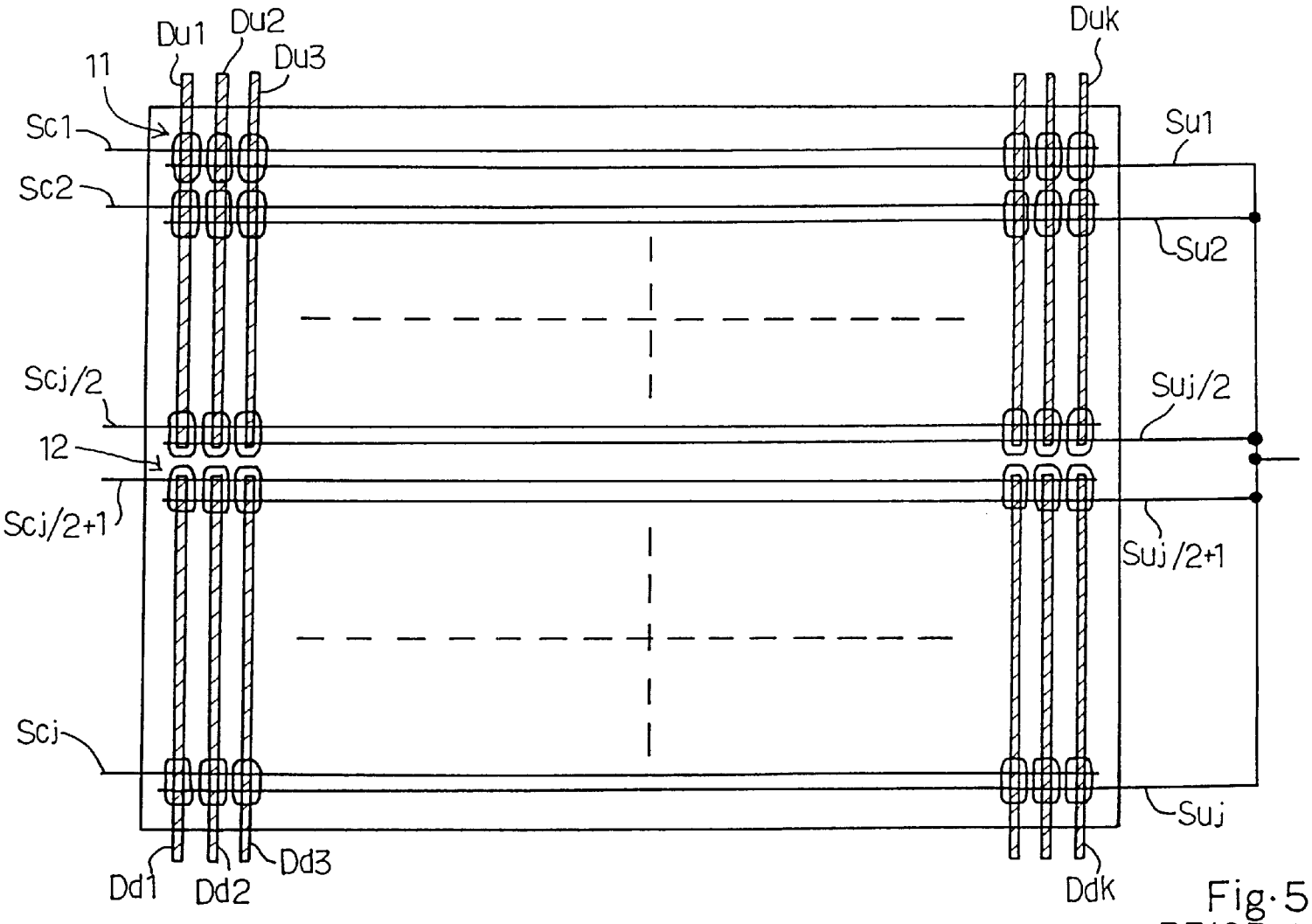
Fig. 5 PRIOR ART
FIG. 5 is a plane view showing the arrangement of the pixels and the electrodes incorporated in the prior art memory type alternating current plasma display panel proposed by Uchidoi et al.
Figure 6:
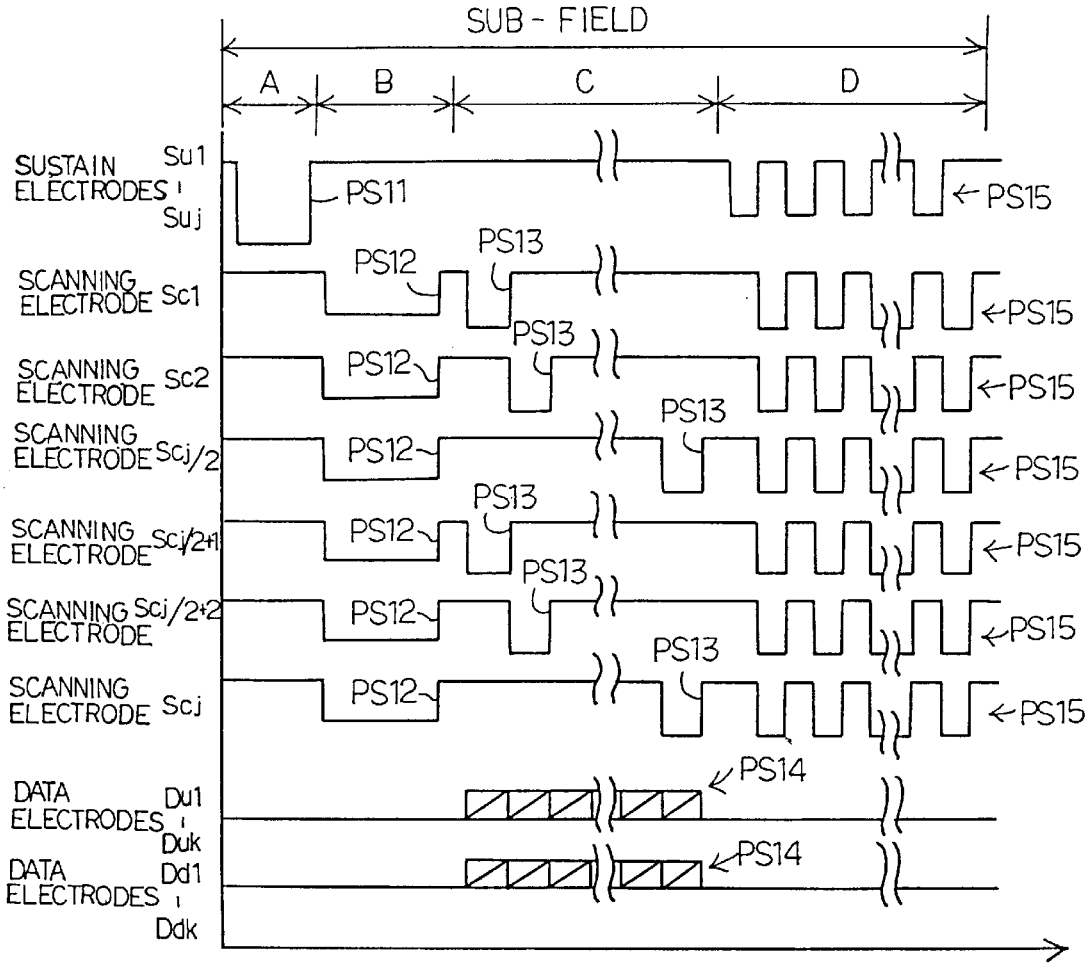
Fig. 6 PRIOR ART
FIG. 6 is a diagram showing the variation of potential levels on the electrodes during the sub-field.
Figure 7:
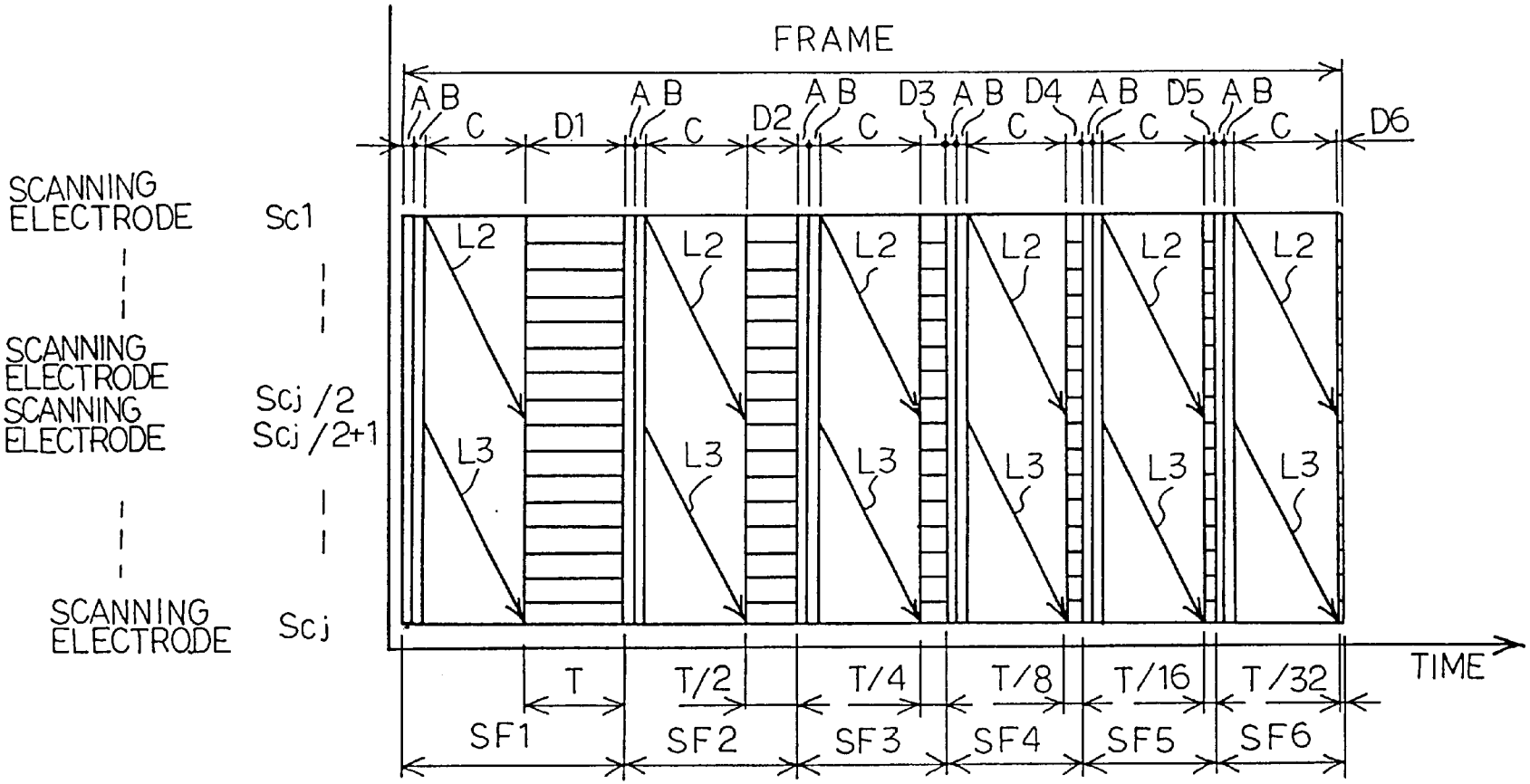
Fig. 7 PRIOR ART
FIG. 7 is a timing chart showing the prior art control sequence proposed by Uchidoi et al.
Figure 8:
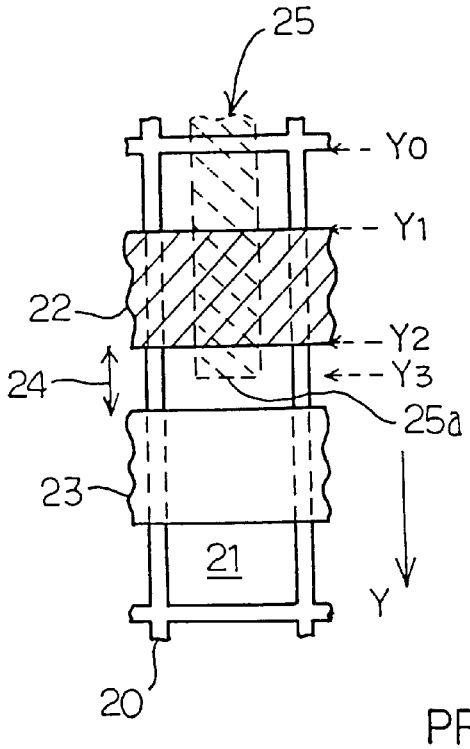
Fig.·8 PRIOR ART
FIG. 8 is a plane view showing the relative position between the scanning electrode and the data electrode in the pixel incorporated in the prior art memory type alternating current plasma display panel proposed by Uchidoi.
Figure 9:
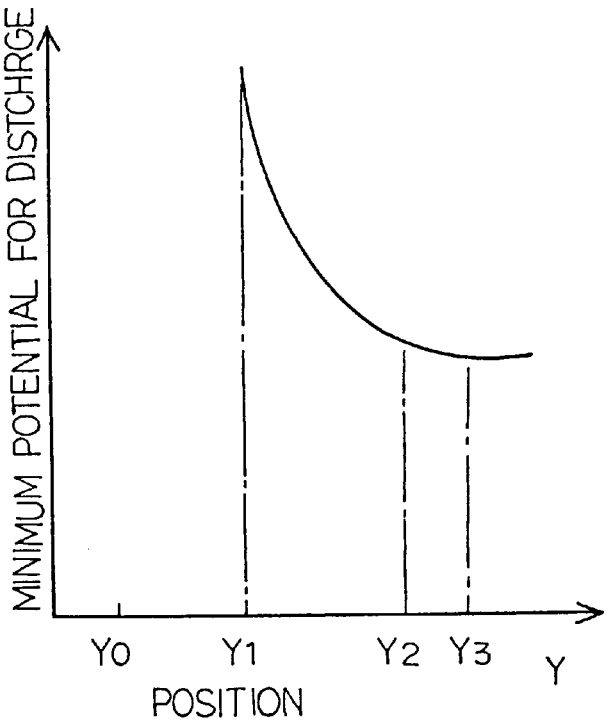
Fig.·9 PRIOR ART
FIG. 9 is a graph showing the variation of minimum potential for the discharge in terms of the position of the data electrode.
Figure 10D:
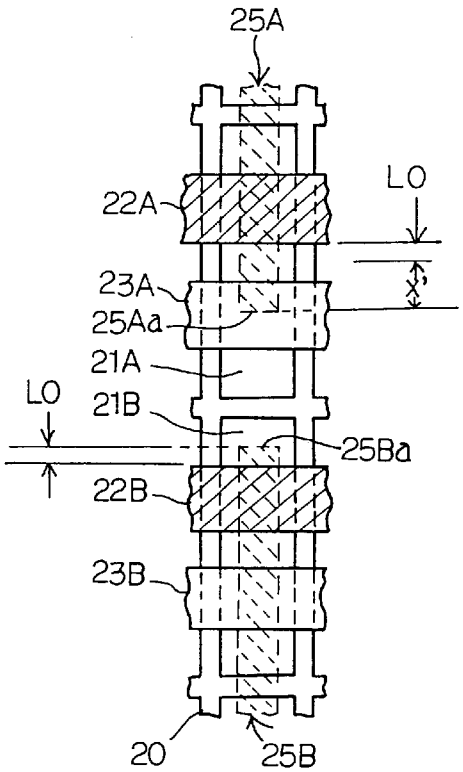
Fig·10D PRIOR ART
FIGS. 10A to 10D are plane views showing the relative position between the scanning electrode and the data electrode under the different offset.
Figure 10C:
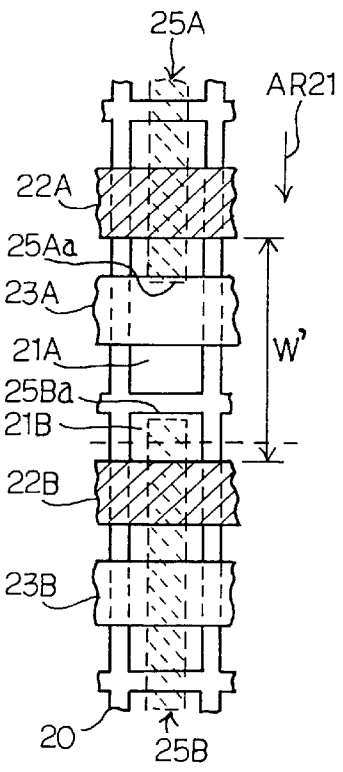
Fig·10C PRIOR ART
Figure 10B:
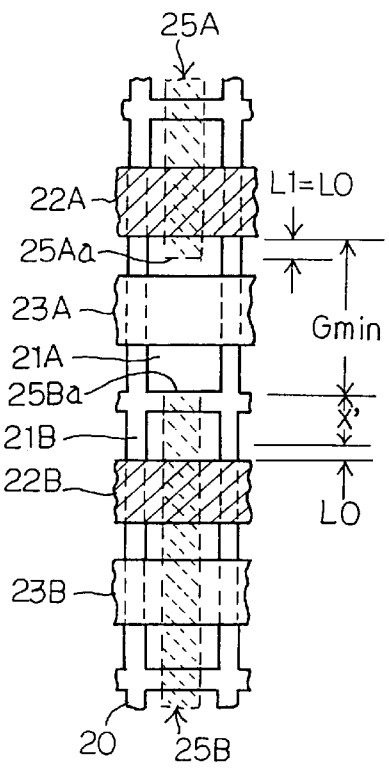
Fig·10B PRIOR ART
Figure 10A:
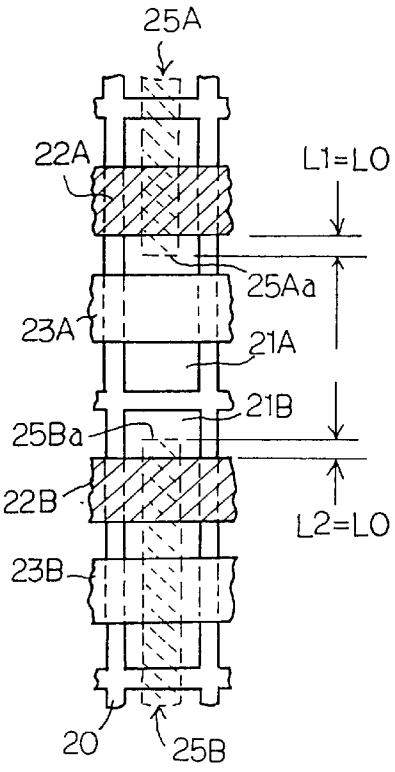
Fig·10A PRIOR ART

If the write-in characteristics are small regardless of the relation of the scanning direction and the electrode arrangement, it is possible to use the prior art control sequence shown in FIG. 7 for the memory type alternating current plasma display panel according to the present invention.

The arrangement of scanning/sustain electrodes is never limited to those shown in FIGS. 11 and 18 in so far as plural sustain electrodes are inserted between the innermost scanning electrodes.

A memory type alternating current plasma display panel according to the present invention may have more than two pixel blocks. In this instance, the innermost sustain electrodes of every two pixel blocks are closer to the boundary than the associated innermost scanning electrodes.

The present invention may apply any kind of plasma display panel in so far as the pixels are divided into plural pixel blocks. In detail, the present invention is applicable to a refresh type alternating current plasma display panel and any kind of direct current plasma display panel.

What is claimed is:

1. A plasma display panel comprising:

a plurality of pixel blocks having at least first pixel block and a second pixel block provided on one side of a boundary and the other side of said boundary, a plurality of first scanning electrodes extending in a first direction, a plurality of first sustain electrodes extending in said first direction, respectively paired with said plurality of first scanning electrodes so as to form a plurality of first electrode pairs selectively associated with pixels of said first pixel block and having the inner most first sustain electrode closer to said boundary than the associated innermost first scanning electrode, a plurality of first data electrodes opposed to said plurality of first electrode pairs through a first discharging space, extending in a second direction perpendicular to said first direction and selectively associated with said pixels of said first pixel block, a plurality of second scanning electrodes extending in said first direction, a plurality of second sustain electrodes extending in said first direction, respectively paired with said plurality of second scanning electrodes so as to form a plurality of second electrode pairs selectively associated with pixels of said second pixel block and having the inner most second sustain electrode closer to said boundary than the associated innermost second scanning electrode, and a plurality of second data electrodes opposed to said plurality of second electrode pairs through a second discharging space, extending in said second direction and selectively associated with the pixels of said second pixel block, in which said plurality of first data electrodes and said plurality of second data electrodes are provided on both sides of a spacer wall having a center line substantially coincident with said boundary, and a first distance between said innermost first scanning electrode and said spacer wall is larger than a second distance between said innermost second scanning electrode and said spacer wall, wherein a third distance between said plurality of first data electrodes and said plurality of second data electrodes is equal to or greater than a difference between said first distance and a minimum projection of said plurality of first data electrodes from the associated innermost scanning electrode so as to minimize a potential difference for generating a discharge therebetween.

2. The plasma display panel as set forth in claim 1, in which each of said plurality of first electrode pairs and each of said plurality of second electrode pairs respectively have the first sustain electrode and the second sustain electrode closer to said boundary than the associated first scanning electrode and the associated second scanning electrode, respectively.

3. The plasma display panel as set forth in claim 2, in which said plurality of first electrode pairs and said plurality of second electrode pairs are formed on an inner surface of a first panel and covered with a first dielectric structure, and said plurality of first data electrodes and said plurality of second data electrodes are formed on a second panel covered with a second dielectric structure and spaced from said first panel by means of a spacer.

4. The plasma display panel as set forth in claim 1, in which said plurality of first electrode pairs alternately change the first sustain electrode and the first scanning electrode between an outer position and an inner position closer to said boundary than said outer position, and said plurality of second electrode pairs alternately change the second sustain electrode and the second scanning electrode between said outer position and said inner position.

5. The plasma display panel as set forth in claim 4, in which said plurality of first electrode pairs and said plurality of second electrode pairs are formed on an inner surface of a first panel and covered with a first dielectric structure, and said plurality of first data electrodes and said plurality of second data electrodes are formed on a second panel covered with a second dielectric structure and spaced from said first panel by means of a spacer.

6. The plasma display panel as set forth in claim 1, in which a fourth distance between said plurality of first data electrodes and said plurality of second data electrodes is equal to or less than a difference between a fifth distance between said innermost first scanning electrode and said innermost second scanning electrode and a value twice larger than a minimum projection of said plurality of first data electrodes from the associated innermost scanning electrode so as to minimize a potential difference for generating a discharge therebetween.

7. The plasma display panel as set forth in claim 1, which a primary discharging pulse is applied to said plurality of first sustain electrodes and said plurality of second sustain electrodes in a first time period of a field, an erasing pulse is applied to said plurality of first scanning electrodes and said plurality of second scanning electrodes in a second time period of said field after said first time period, a scanning pulse signal is sequentially applied to said plurality of first scanning electrodes and said plurality of second scanning electrodes in a third time period of said field after said second time period, a data pulse signal is selectively applied to said plurality of first data electrodes. and said plurality of second data electrodes in said third time period, and a sustain pulse signal is alternately applied to said plurality of first and second sustain electrodes and said plurality of first and second scanning electrodes in a fourth time period of said field after said third time period.

8. The plasma display panel as set forth in claim 7, in which said plurality of first scanning electrodes are respectively paired with said plurality of second scanning electrodes so as to form a plurality of scanning electrode pairs, and said scanning pulse signal is sequentially applied to said plurality of scanning electrode pairs.

9. The plasma display panel as set forth in claim 7, in which said field and other fields each having said first time period to said fourth time period are arranged in series, and form a frame for producing an image.

10. A method for controlling a plasma display panel, said plasma display panel comprising a plurality of pixel blocks having at least first pixel block and a second pixel block provided on one side of a boundary and the other side of said boundary, a plurality of first scanning electrodes extending in a first direction, a plurality of first sustain electrodes extending in said first direction, respectively paired with said plurality of first scanning electrodes so as to form a plurality of first electrode pairs selectively associated with pixels of said first pixel block and having the inner most first sustain electrode closer to said boundary than the associated innermost first scanning electrode, a plurality of first data electrodes opposed to said plurality of first electrode pairs through a first discharging space, extending in a second direction perpendicular to said first direction and selectively associated with said pixels of said first pixel block, a plurality of second scanning electrodes extending in said first direction, a plurality of second sustain electrodes extending in said first direction, respectively paired with said plurality of second scanning electrodes so as to form a plurality of second electrode pairs selectively associated with pixels of said second pixel block and having the inner most second sustain electrode closer to said boundary than the associated innermost second scanning electrode, and a plurality of second data electrodes opposed to said plurality of second electrode pairs through a second discharging space, extending in said second direction and selectively associated with the pixels of said second pixel block, in which said plurality of first data electrodes and said plurality of second data electrodes are provided on both sides of a spacer wall having a center line substantially coincident with said boundary, and a first distance between said innermost first scanning electrode and said spacer wall is larger than a second distance between said innermost second scanning electrode and said spacer wall, wherein a third distance between said plurality of first data electrodes and said plurality of second data electrodes is equal to or greater than a difference between said first distance and a minimum projection of said plurality of first data electrodes from the associated innermost scanning electrode so as to minimize a potential difference for generating a discharge therebetween, the method comprising:

generating a write-in discharge between said data electrodes and said first and second scanning electrodes in such a manner that said write-in discharge sequentially takes place in said first pixel block in a first direction and in said second pixel block in a second direction opposite to said first direction with respect to said boundary; and generating a sustain discharge in pixels entered in a write-in state by generating said write-in discharge between said data electrodes and said first and second scanning electrodes.

11. The method as set forth in claim 10, wherein the method further comprises generating a preliminary discharge in said first pixel block and said second pixel block before generating said write-in discharge between said data electrodes and said first and second scanning electrodes.

12. The method as set forth in claim 11, wherein the method further comprises generating erasing discharge in said first pixel block and said second pixel block after generating said preliminary discharge in said first pixel block and said second pixel block and prior to generating said write-in discharge between said data electrodes and said first and second scanning electrodes.

* * * * *